United States Patent [19]

Eisterhold

[11] Patent Number: 5,011,078

[45] Date of Patent: Apr. 30, 1991

[54] SURFACE MARKING METHOD TO OBTAIN UNIFORM COATING

[76] Inventor: Charles A. Eisterhold, Star Rte. 2, Jefferson City, Mo. 65101

[21] Appl. No.: 314,309

[22] Filed: Feb. 22, 1989

Related U.S. Application Data

[63] Continuation of Ser. No. 155,903, Feb. 16, 1988, abandoned.

[51] Int. Cl.[5] ..... B05B 17/00

[52] U.S. Cl. ..... 239/1

[58] Field of Search ..... 239/1, 71, 72, 74; 222/39

[56] References Cited

U.S. PATENT DOCUMENTS

| | | | |
|---|---|---|---|
| 2,065,998 | 12/1936 | Emmons | 91/45 |
| 2,345,076 | 3/1944 | Spencer | 91/12 |
| 2,516,173 | 7/1950 | Ballew | 91/12 |
| 3,318,529 | 5/1967 | Ferm et al. | 239/69 |
| 3,330,482 | 7/1967 | Crowe | 239/74 |
| 3,373,938 | 3/1968 | Sweet | 239/73 X |
| 3,653,596 | 4/1972 | Abrams et al. | 239/93 |
| 4,093,107 | 6/1978 | Allman | 239/74 X |

OTHER PUBLICATIONS

The Winfrey Gun Holster, Brochure, (Circa 1978).

*Primary Examiner*—Andres Kashnikow
*Assistant Examiner*—Kevin P. Weldon

[57] ABSTRACT

A marking system and a spraying system preferably for use with coating or foaming a generally flat surface, has a marking apparatus generally including a measuring device, an encoding device, a counter-controller device and a marking device; and a spray apparatus including a pump, a spray material reservoir, a nozzle, counter-roller and a signal receiving means. A method for spraying is provided that generally includes the steps of defining a grid, spacing a plurality of marks within the grid, pumping a spray material, generating and transmitting a signal, and spraying the surface in response to the signal and in reference to the grid.

1 Claim, 4 Drawing Sheets fig 1.
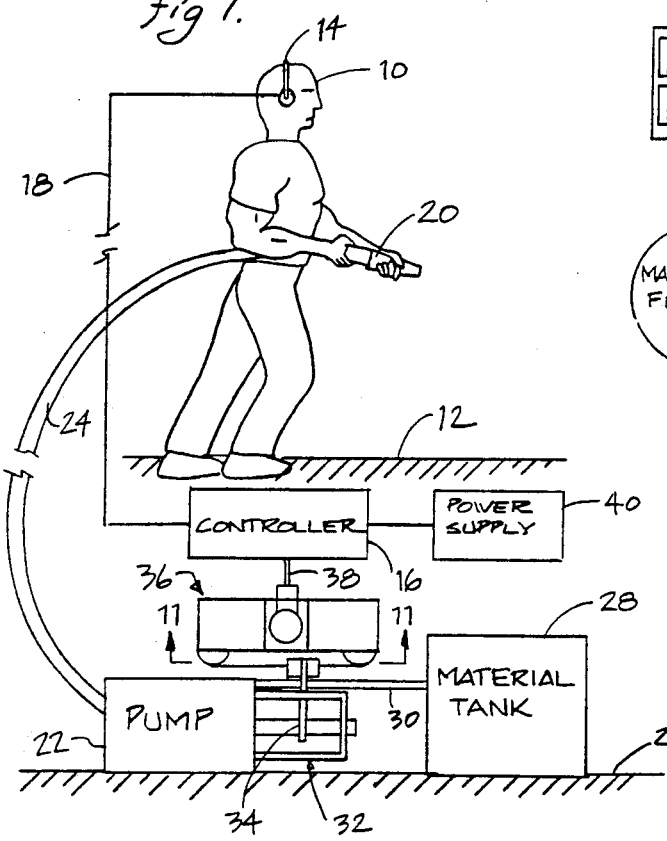
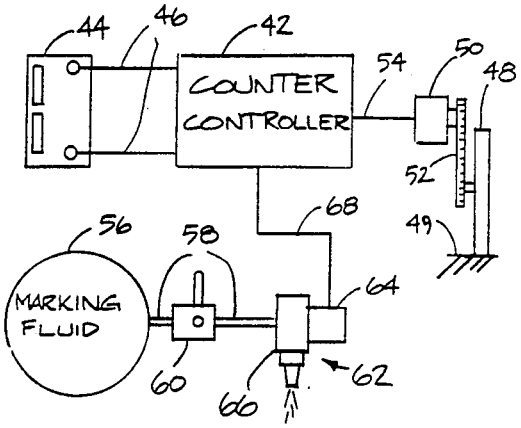
fig 2.
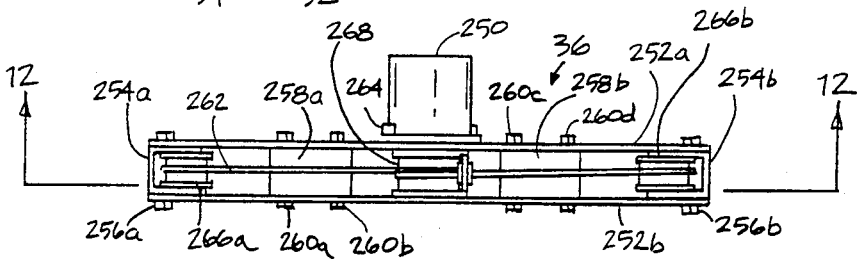
fig 11.
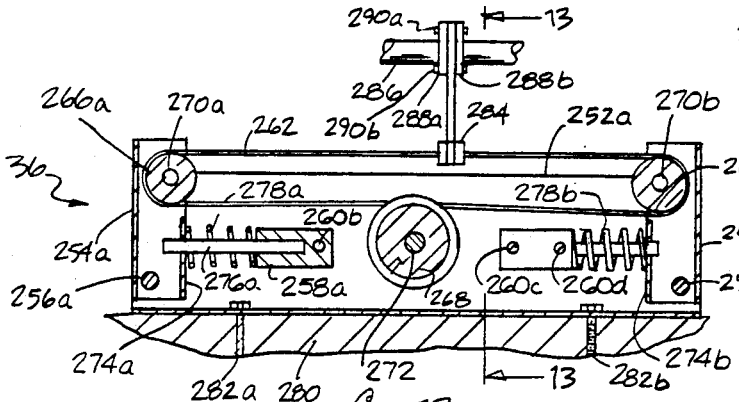
fig 12.
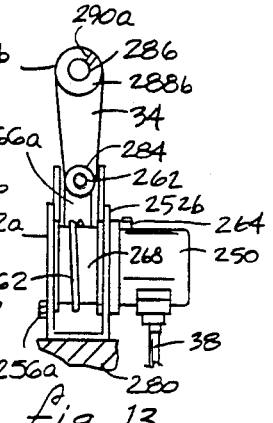
fig 13.

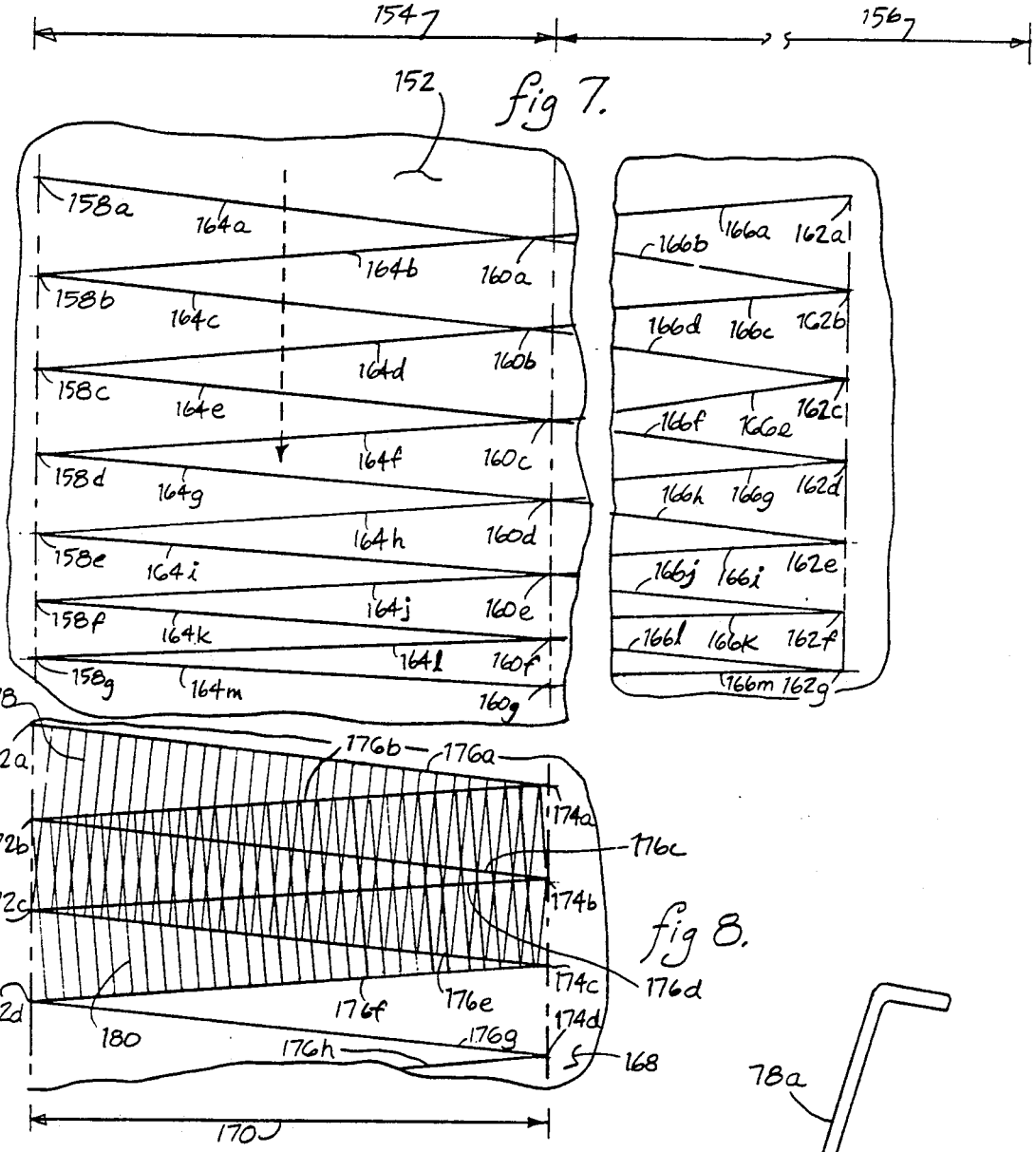
fig 7.
fig 8.
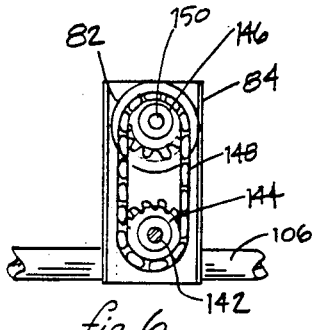
fig 6.
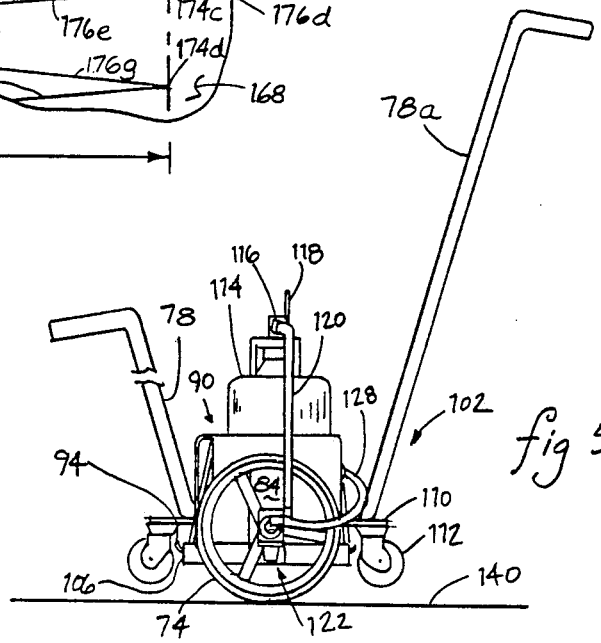
fig 5.

SURFACE MARKING METHOD TO OBTAIN UNIFORM COATING

This is a continuation of co-pending application Ser. No. 07/155,903, filed on Feb. 16, 1988, abandoned.

BACKGROUND OF THE INVENTION

This invention relates generally to a spraying system, an associated marking system and a method for using both to spray or coat a surface and more particularly to a spray system for coating or insulating a relatively flat surface, a marking system for defining a grid on the relatively flat surface and a method for using the spray system and the marking system in order to spray coat or foam the relatively flat surface with a desired quantity of material thereby providing a desired finished thickness.

Spray systems for coating roofs with a sealant or other protective coatings are well known. Material manufactured for roof coating has been improved significantly in recent years. As a result, the final thickness of the material can now be measured in mils (one mil=0.001 inch).

The improvement in the material has produced an increase in the cost of the material and a decrease in the tolerance allowed for an acceptable coating. Two of the most common materials now sprayed on roofs, decks and the like are a sprayed polyurethane foam and a sprayed elastomeric coating system. The latter can be used as a base for the former. The increase in cost and decrease in tolerance has created a dilemma for the spray contractor, plant manager and engineer or anyone else responsible for providing or obtaining at least the minimum coating thickness for the lowest price. This dilemma has presented a challenge to the manufacturers of spray equipment as well in that they must meet a challenge to provide increasingly accurate spraying systems in an industry that relies, and has relied for years, almost entirely on the skill of a sprayer to lay down the desired thickness of a material and no more.

It is known to mark off an area of several hundred square feet (or squares) and then spray the area. The amount of coating is then checked (by either measuring the thickness of the coating or the amount of material sprayed since by simple arithematic the coating thickness per area can be used to calculate the amount of material it takes, for example, in gallons or gallons per square) for accuracy. The spray gun operator has only his experience to determine the approximate amount of coating to be applied. If too much material was sprayed, then the operator attempts to spray less on the next section tested, if in fact it is tested again. Testing a sample square footage is inaccurate due to measurements of the material sprayed. Ultimately, the operator relies almost totally on experience and skill to spray the correct amount (thickness) on the surface to be coated.

The ability of a spray operator to apply a coating in a proper thickness can be affected by a number of factors. The following are just a few of the factors affecting the finished coating thickness. The viscosity of the material can vary from drum to drum. The viscosity can also vary with ambient temperature. Viscosity variations are difficult for the spray operator to detect in order to adjust the spray pattern. Spray operator fatigue, adverse ambient conditions, and time of day can all affect the spray operator's judgment as to how much coating is being applied.

A spray hose supplying the material is typically controlled by a helper, a "hose person". The hose person is responsible for managing the hose to keep it out of the spray operator's way. The hose person can affect the amount of coating sprayed in a number of ways. For example, too much or too little tension on a hose will either pull the spray operator backwards across the surface too quickly or too slowly as the spray operator waits for the hose to be pulled back. Both the speed of movement and spray width have been found to be affected by the actions of the hose person.

Accordingly, it is an object of the present invention to provide a spray system and method including spray apparatus and marking apparatus and a method for using the apparatus.

It is another object of the present invention to provide an apparatus and method that enables a spray operator to accurately spray a desired amount of material to a desired area of a roof or other surface.

It is another object of the present invention to provide an apparatus and method for applying a grid to a surface to be sprayed and coated. The grid effectively divides the roof into small segments. The grid marks off a lane for the spray operator and provides means for regulating the speed of the spray operator and back and forth spraying action.

It is another object of the present invention to provide an apparatus and method that provides a tighter control on the cost of a spray or coating project. The coating thickness is controlled, thereby keeping the spray operator from spraying extra material "just in case" which increases the cost of materials.

It is another object of the present invention to provide an apparatus and method that reduces or eliminates the need to re-coat a surface, thereby increasing the cost of the spray or coating project. If too little material is sprayed and the coating thickness does not meet the minimum specified thickness, then the cost of re-spraying includes quite often both another primer coat and a finished coat.

It is another object of the present invention to provide an apparatus and method that effectively links the spray operator with a ground crew and the equipment located on the ground or otherwise remote from the spray operator.

It is another object of the present invention to provide an apparatus and method that can provide an evenly sprayed coating with no thick or thin spots. The even coating results in part from the substantially uniform passes that a spray operator can make with the spray equipment by using a grid pattern defining lanes to guide the spraying.

It is another object of the present invention to provide an apparatus and method that can be readily used to spray foam (e.g., foam insulation) with a tapered thickness.

It is another object of the present invention to provide an apparatus and method that can be readily used by a number of spray operators without a resulting variation in thickness due to the particular style of the spray operators. The apparatus and method of the present invention further provides for a reduction of stress to the spray operator. The grid relieves a significant portion of the tension associated with the task of applying the proper thickness of the coating or foam material. The present invention provides for the use of spray operators regardless of skill or experience.

SUMMARY OF THE INVENTION

To accomplish the foregoing and other objects of the invention there is provided a marking apparatus and a spray apparatus. The marking apparatus generally includes a measuring means, an encoding means, a controller means and a marking means. The measuring means measures a generally linear distance along a surface that is to be sprayed with, for example, a coating or a foam. The measuring means generates a first signal. The first signal corresponds to a linear distance. The encoding means receives the first signal and generates a second signal proportional to the first signal. The encoder transmits the second signal which is received by a controller means. The second signal is transformed by the controller means to a third signal. A marking means receives the third signal and then causes a grid to be marked on the surface to be sprayed.

There is further provided a spray apparatus generally including a pump means, a spray material reservoir, a spray material transfer means, a spray means, an encoder means, and a signal receiving means. The pump means transfers the spray material from the spray material reservoir through the spray material transfer means to the spray means. Typically, an operator controls the spray means and directs the spray material on to a generally flat surface. The encoder means receives a first signal from the pump means and generates a second signal corresponding to an amount of spray material transferred by the pump means from the spray material reservoir through the spray material transfer means end to the spray means. The signal receiving means receives the second signal and signals the operator to move the spray means within a grid. Thus, movement of the spray means by the operator in response to the received signal provides for the spray material to be applied to the generally flat surface in a pre-determined thickness.

There is further provided a method for spraying a generally flat surface with a spray material. The method generally includes the steps of defining a grid, spacing a plurality of marks, pumping the spray material, generating a signal, transmitting the signal, and spraying the generally flat surface. The grid is defined on the flat surface and the grid includes a plurality of marks on the flat surface. The plurality of marks are spaced to correspond to a spray frequency within a corresponding portion of the grid. The spray material is pumped from a spray material reservoir to a spray means. The spray means provides for directing the spray material on to the generally flat surface. The signal is generated in correspondence to a desired amount of spray material pumped to the spray means. The signal is transmitted to a spray operator controlling the spray means. The generally flat surface is sprayed within the grid portion by the spray means in the control of the spray operator. The spraying motion of the spray operator is in response to the transmitted signal and the desired amount of spray material is put down on the generally flat surface.

These and other objects and features of the present invention will be better understood and appreciated from the following detailed description taken in conjunction with the following drawings.

BRIEF DESCRIPTION OF THE DRAWINGS

FIG. 1 is a diagram of a spray apparatus of the present invention;

FIG. 2 is a diagram of a marking apparatus of the present invention;

FIG. 5 is an elevation view of the marking apparatus in FIG. 3 as viewed from the right side;

FIG. 6 is a cross-section view taken along line 6—6 in FIG. 4;

FIG. 7 is a diagram of a surface to be sprayed in accordance with the present invention;

FIG. 8 is a diagram of a surface to be sprayed in accordance with the present invention illustrating a grid and a spray pattern;

FIG. 11 is a cross-section view taken along line 11—11 in FIG. 1;

FIG. 12 is a cross-section view taken along line 12—12 in FIG. 11;

FIG. 13 is a cross-section view taken along line 13—13 in FIG. 12;

DESCRIPTION OF THE PREFERRED EMBODIMENT

Figure 3:
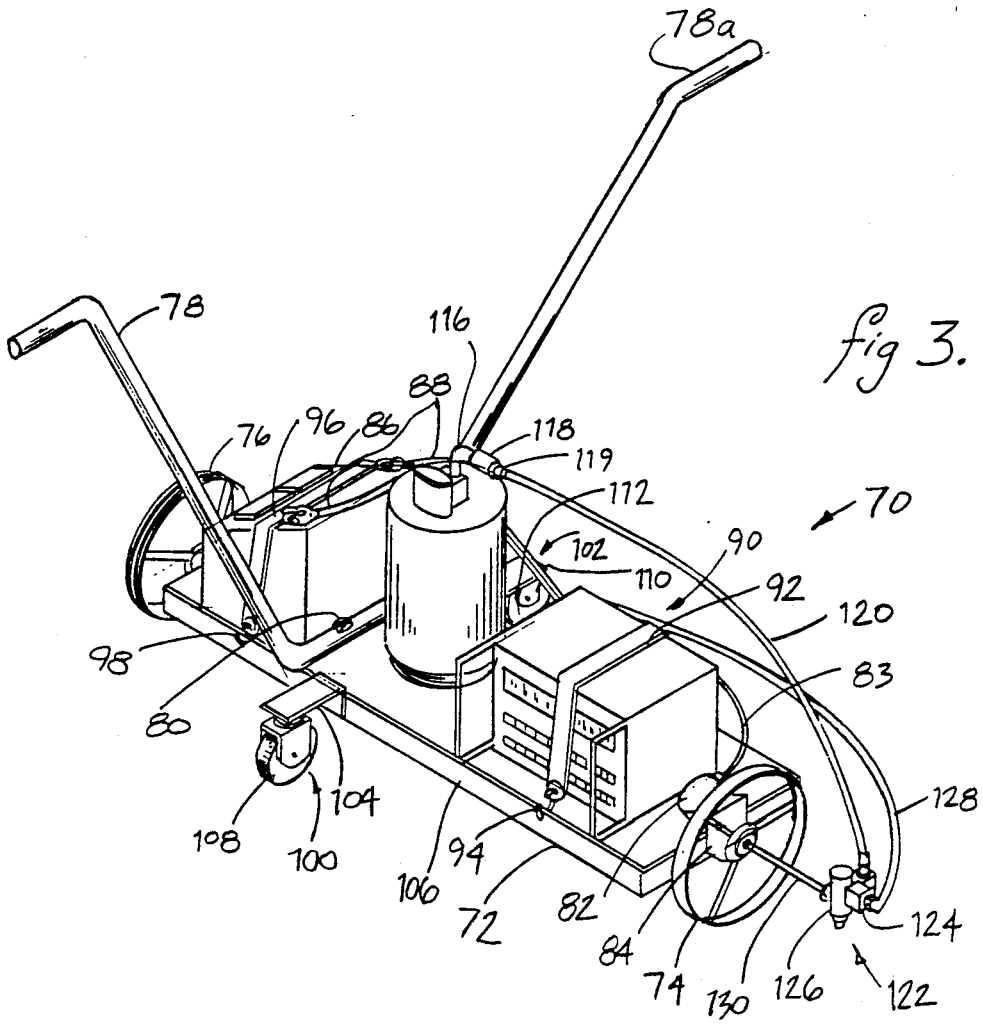
FIG. 3 is a perspective view of a marking apparatus of the present invention.
Figure 4:
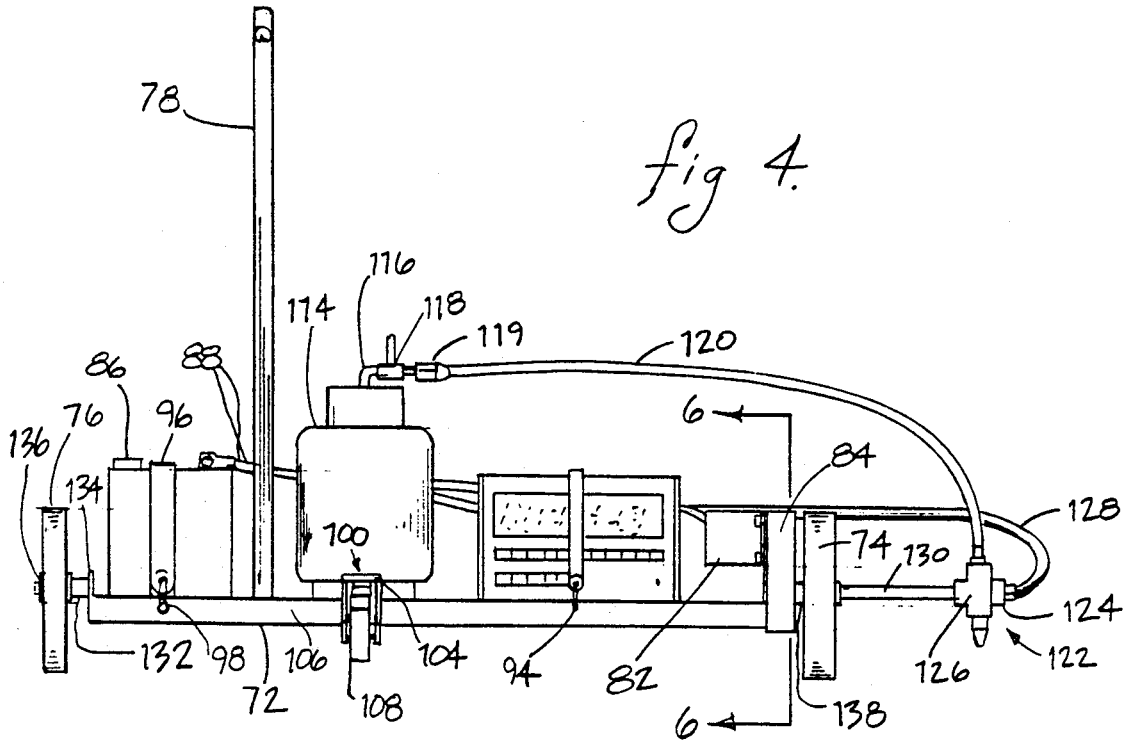
FIG. 4 is an elevation view of the marking apparatus in FIG. 3 as viewed from the front.

Referring now to the drawings there is shown a preferred embodiment for the marking apparatus and the spray apparatus of this invention. The marking apparatus is described in connection with the marking of a grid for spraying a roof with an elastomeric coating system and a sprayed foam insulation. The spray apparatus is described in connection with the spraying application of a spray material such as the elastomeric coating or sprayed foam. The marking apparatus and the spray apparatus provide a system for coating the roof and a preferred method is described.

The spray apparatus shown in FIG. 1 is composed of an operator 10 located on a generally flat surface 12 such as a roof, wearing signal receiving means, such as headphones 14. The headphones are connected to a counter-controller 16 by a signal wire 18. The connection could also be, for example, a radio frequency transmitter and receiver combination. The counter-controller 16 provides a signal generating means as described in further detail below. The operator is holding a spray means which in a preferred embodiment consists of a spray gun 20. The spray means is controlled by the operator for directing the spray material on the generally flat surface. Spray guns are well known and the drawing of the spray gun in FIG. 1 is for illustration purposes only.

Pumping means for transferring the spray material is provided in the described embodiment by a reciprocating, double-acting piston, positive displacement pump 22. The pump 22 transfer the spray material through a spray material transfer means, for example, a hose 24 in the described embodiment. The hose is connected at one end to the pump 22 and to the spray gun 20 at the other end as shown in the diagram of FIG. 1. The pump 22 and associated apparatus are typically assembled in a truck bed or on the ground 26. A material supply tank 28 provides a spray material reservoir. The spray material reservoir will be sized and designed to meet the requirements of the spray project as understood by one skilled in the art. Completing the spray material circuit is a transfer means 30 between the tank 28 and the pump 22.

The diagram in FIG. 1 includes a representation of a pump reciprocating shaft and assembly 32. Existing spray equipment, i.e. pump, reservoir, hose and spray means, includes this or a similar assembly. In the described embodiment a connector rod 34 extends between the assembly 32 and an encoder means 36. The encoder means 36 receives a first signal from the pump means and generates a second signal corresponding to an amount of spray material transferred by the pump means. The encoder means including a counter-controller receives a signal via an encoder mean output signal wire 38. A power supply 40 is provided, particularly useful for those instances when power is not otherwise available for the counter-controller 16. The signal receiving means receives the second signal indicating to the operator when to move the spray means within a grid on the surface to be sprayed, thereby providing a pre-determined thickness of spray material.

The marking apparatus shown in FIG. 2 is composed of a battery 44, although other power sources may be used, for example, a gasoline generator, connected to a counter-controller 42. A pair of cables 46 connect the battery 44 and the counter-controller 42.

A measuring means is provided by a marker wheel 48 is positioned to roll along a roof 49 or other generally flat surface, either horizontal or vertical, and the rotation of the wheel generates a first signal which is received by an encoder means, such as a rotary encoder 50 by means of an inter-connecting chain, inter-meshing pulley, or other positive, non-slipping connector 52. The rotary encoder 50 generates a second signal that is transmitted to a counter-controller means, such as counter-controller 42 over an encoder signal line 54.

A marking fluid reservoir 56 provides a supply of a marking fluid. The reservoir can be pressurized or a small pump can be used to transfer the marking fluid through a marking fluid supply line 58. A shut-off or isolation valve 60 can be provided to expedite removal of the reservoir or isolate the reservoir from a marking means 62. The marking means 62 provides a marking means for defining a grid on the roof or other generally flat surface 49 as described in further detail below. In a preferred embodiment the marking means comprises a solenoid 64 controlling the pressurized flow of marking fluid through a spray nozzle and valve combination 66. An output signal line 68 from the counter-controller 42 transmits a signal generated by the counter-controller 42 corresponding to a linear measurement supplied by rotation of the marker wheel 48 to provide the desired grid as defined by the marking fluid sprayed through the nozzle 66 on to the roof 49.

In a preferred embodiment a marking apparatus and cart combination 70 is shown in FIG. 3 and includes a cart 72 on which is assembled components of the marking apparatus. A marker wheel 74 and a follower wheel 76 provide primary means for rolling the marking apparatus across a roof or along another generally flat surface. A handle 78 is provided which can be connected to the cart 72 by fasteners 80. The handle alternate location identified as 78*a* allows the cart to be moved back-and-forth when marking a grid without it being necessary to turn the cart around at the end of each pass (or lane as further described.

A rotary encoder 82 is mounted on cart 72 and is connected to the marker wheel 74 through a chain or gear within a housing 84. A rotary encoder output signal line 83 transmits the signal generated by the rotary encoder 82 to the controller means, such as a counter-controller 90. Power for the signal generating apparatus can be provided by a battery 86 through battery cables 88. Conveniently mounted on the cart 72, the counter-controller can be removed for use with the spray apparatus. Thus, the cost of equipment is reduced. In a preferred embodiment a counter-controller hold down strap 92 fits over the counter-controller 90. The strap can be elastic and include a hook 94 for engagement with a hole in the cart 72 as suggested by the drawings in FIG. 3. The hold-down strap 92 can have a hook at both ends for ease of removal. The battery 86 can be transferred to the spray apparatus along with the counter-controller 92, thereby alleviating the need for either a duplicate counter-controller or battery. Associated with the battery is a battery hold-down strap 96 including another hook 98 also intended for engagement with another hole in the cart 72. The hold-down strap 96 can have a hook at both ends for ease of removal.

A pair of outboard wheel assemblies 100 and 102 provide for balancing the cart for easy movement. An angle 104 is attached to a peripheral wall 106. A caster 108 or other transport means is attached at the outwardly extending end of angle 104. Another angle 110 is also attached to the peripheral wall 106 on the opposite side of cart 72 from angle 104. Another caster 112 or other transport means is attached at the outwardly extending end of angle 110. The outboard wheel assemblies 100 and 102 support part of the weight of cart 72 to allow a marking apparatus operator to roll the cart while the outboard wheels support the weight of the cart and the assembled components.

The assembled components further include a marking fluid reservoir 114 containing a supply of marking fluid, preferably under pressure. A supply line connection 116 with pressure tight fittings is provided and a shut-off valve 118, such as a ball valve isolates the connection 116 from a pressurized marking fluid supply line 120. In a preferred embodiment a pressure-tight connect-disconnect fitting 119, such as a union, allows disconnection and connection of pressurized marking fluid supply line 120 when the isolation valve 118 is closed.

The supply line 120 provides a pressure tight supply means from marking fluid reservoir 114 to a spray or marking means, such as spray apparatus 122. The spray apparatus preferably consists of an electrically operated solenoid 124 and a spray nozzle 126. It will be understood that any remote control spray apparatus can be used. The second signal is transformed by the controller means to a third signal corresponding to a control signal for marking a desired grid pattern, the third signal is transmitted from counter-controller 90 to the spray apparatus 122 by means of a counter-controller output signal line 128. The spray apparatus 122 can be supported outwardly from cart 72 by a spray marker support extension 130. The distance from the center line of the spray marker apparatus 122 or more specifically, from the center of any sprayed mark to the follower wheel 76 must be known. A plurality of sprayed marks form a grid that defines one or more lanes and the width of the lanes determines in part a desired spray pattern for a desired coating or foam thickness. The extension 130 extends generally outwardly from marker wheel 74 axle 138 and is mounted thereto with an appropriate bushing since the support extension 130 typically does not rotate.

A follower wheel axle 132 is mounted on the cart 72 by a suitable axle support bearing or bushing assembly 134. A follower wheel retaining member or hub 136 maintains the follower wheel 76 in its desired position for a smooth and straight track as the cart and marking apparatus are rolled back and forth to spray marks defining the grid. It will be understood that spraying is only one means for placing the desired marks, for example, a stamp means or adhesive backed marker could also be used. This will be better understood from the description of the method of the present invention set forth below.

The outer circumference of the marker wheel 74 is known. The outer circumference of the follower wheel 76 must be substantially the same as the outer circumference of marker wheel 74 in order for the cart to follow a relatively straight line without unnecessary steering of the cart 72 by the operator. The rotation of the marker wheel 74 is translated into a linear dimension by means of the arrangement of components in the chain or gear housing 84.

In the embodiment shown in FIG. 6 a chain and sprocket arrangement is shown. A plurality of gears or another positive connection arrangement can be used that doesn't result in slippage as will be better understood from the following description of the illustrated embodiment. A marker wheel axle 142 carries a marker wheel axle sprocket 144. An encoder sprocket 146 is rotated in direct correspondence to the marker wheel 74 due to a drive chain 148 that extends between sprockets 144 and 146. The encoder sprocket 146 is connected to a rotary encoder input shaft 150. Thus, rotation of the marker wheel 74 results in a corresponding rotation of the rotary encoder input shaft 150. The rotary encoder 82, as a result, generates a signal corresponding to the movement of the marker wheel 74 and transmits the generated signal to the counter-controller 90 by means of the rotary encoder signal line 83. Thus, a signal corresponding to linear movement of cart 72 is input to the counter-controller 90.

A grid defined by the marking apparatus 70 will now be discussed with reference to FIGS. 7 and 8. A roof, floor or other surface to be sprayed or coated is indicated by reference character 152. Two lanes 154 and 156 have been represented for purposes of description. A row of marks 158*a–g* and an adjacent row of marks 160*a–g* and another adjacent row of marks 162*a–g* define adjacent lane 156. It will be understood that this grid of marks would be continued across that portion of surface 152 that is intended to be sprayed or coated.

The three rows of lane markers 158*a–g*, 160*a–g* and 162*a–g* in FIG. 7 define a grid. The markers are not directly across from each other, but are staggered such that a series of lines connecting the markers form a zig-zag pattern along the lanes 154 and 156. These lines 164*a–m* and 166*a–m* are not intended to be placed on surface 152, but represent spray path centerlines in the one lane 154 and the adjacent lane 156 as a spray operator typically backs along a lane, for example, lane 154, in the direction of the dashed arrow.

A desired spray pattern is represented in FIG. 8 and includes a roof, floor or other surface 168 to be sprayed and a lane 170 defined by a grid consisting of a row of lane markers 172*a–d* and another, adjacent row of lane markers 174*a–d*. A series of spray path centerlines 176*a–h* represent a spray pattern for coating or foaming surface 168. Spray coverage as the operator sprays along spray path center line 176*c* is indicated by cross-hitched area 178. Spray center line 176*d*, is indicated by another cross-hatched area 180. The operator continues to follow the spray path center lines 176*e–g* to coat or foam the surface 168. The surface is coated or foamed to the desired thickness with four passes as indicated in FIG. 8.

Figure 9:
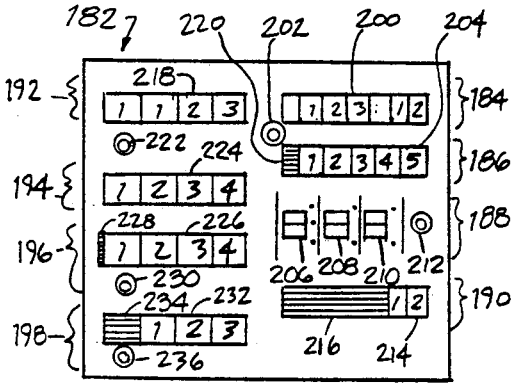
FIG. 9 is a schematic front view of a counter-controller of the present invention.
Figure 10:
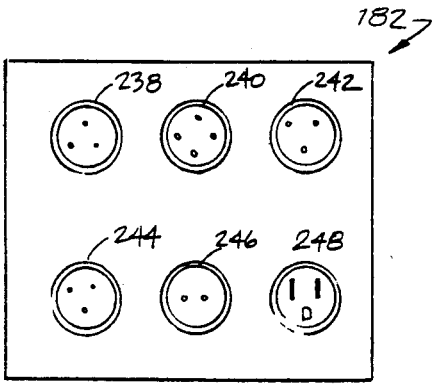
FIG. 10 is a schematic rear view of the counter-controller in FIG. 9.

A preferred embodiment of a counter-controller is shown in FIGS. 9 and 10 and generally indicated by reference character 182. The counter-controller 182 consists of a totalizer panel 184, a multiplier panel 186, a mode switch panel 188, an increment panel 190, a reset panel 192, a present limit panel 194, a limit panel 196 and another limit panel 198. In the preferred embodiment illustrated the totalizer panel 184 includes a totalizer digital LED readout 200 and a reset control 202. The readout could read in total gallons pumped or squares sprayed or foamed depending upon the calibration of the counter-controller. The multiplier panel 186 includes a thumbwheel 220 for setting multiplier readout 204. The mode switch panel 188, as shown in FIG. 9, includes an increment mode control switch 206, a relay control switch 208, a power switch 210, and a relay ready light and rheostat 212. The relay control switch 208 provides means for activating the spray means, such as the solenoid on the marker spray gun. When the counter-controller is in use with the spray apparatus the control switch would typically be in the off position. The power switch 210 provides means for controlling power to the counter-controller. The relay ready light 212 indicates when the relay is on end the rheostat controls the solenoid cycle (typically between 50 and 100 msecs.) in order to control the size of the sprayed marker. The increment panel 190 consists of an increasing-decreasing limit readout 214 and a thumbwheel 216 for setting the increasing-decreasing limit. The reset panel 192 includes a LED readout 218 of the pulse count total, and a pushbutton 222 to reset the LED limit readout. The present limit panel 194 includes a current limit digital LED readout 224. The limit panel 196 includes a first limit readout 226, a thumbwheel 228 for setting the first limit and a first limit mode selection switch 230. The other limit panel 198 includes a second limit readout 232, a thumbwheel 234 for setting the second limit and a second limit mode selection switch 236. The counter-controller 182 functions as described in further detail below. It will be understood that the counter-controller embodiment described herein is intended to be assembled from available components, e.g., totalizers, LED readouts, but that a counter-controller in accordance with the present invention could be designed a d manufactured in accordance with a user's desired specification.

In order to complete the description of the counter-controller 182 a preferred arrangement of signal input and output connectors and power supply connections as shown in FIG. 10 includes spray control output connector 238, an encoder connector 240, a 12-volt power supply connector 242, a marker control output connector 244, a 12-volt spray gun output connector 246 and a 110-volt power supply connector 248.

The present invention includes the reciprocating, double-acting piston shaft and assembly 32, the connector rod 34 and the encoder means 36. These components are shown in substantially more detail in FIGS. 11–13. A pumping means output encoder 250 is attached to one of two framework side members 252a and 252b by means of an encoder mounting plate and fasteners 264. The framework further includes a pair of framework members 254a and 254b. At either end of the framework and intermediate the framework side members are pivot rods 256a and 256b. The framework end members 254a, b are mounted for pivotal movement on the pivot rods 256a, b. Attached to the framework intermediate the framework side members are spring mounting blocks 258a and 258b. As shown in FIGS. 11–13 the spring mounting blocks are fastened to the framework side members by fastening means, such as fasteners or bolts and nuts 260a–d.

A cable 262 extends between a pair of spaced apart cable pulleys 266a and 266b. A sensor pulley 268 is located intermediate the cable pulleys and the cable 262 makes at least one revolution around the sensor pulley 268. In this manner movement of the cable 262 results in movement of the sensor pulley 268. It will be understood that other arrangements may be used not necessarily using cables and pulleys that sense or count the distance traveled during the strokes of a reciprocating piston pump. Cable pulley shafts 270a and 270b intermediate the framework side members provide support for the cable pulleys and allow the cable pulleys to rotate as the cable follows the reciprocating movement of a pump piston extension 286. A sensor pulley shaft 272 transfers the rotary motion of the sensor pulley 268 to the pumping means output encoder 250 as will be further described below.

Each of the framework end members 254a and 254b have a wall means, such as end member walls 274a and 274b, that receive a spring support shaft 276a and 276b, respectively member walls and respective spring mounting blocks 258a, b and about their respective spring support shafts. In this manner the coil springs bias the framework end members outwardly and away from each other, thereby maintaining the cable 262 in tension. It will be understood that other bias means can be used. It will be farther understood that cable tension means other than that described and shown in the drawings could also be used. It will be further understood that the encoder means 36 can be mounted on a support member 280 with suitable bolts or other fasteners 282a, b. Depending on the design of the pump housing, in some instances the pump housing could provide or be the support member.

The connector rod 34 extends from the cable 262 to a piston extension 286. In the described embodiment the connector rod could be held in place on the cable with a bushing 284 fastened around the cable and located on either side of the connector rod 34 to hold it fixed. A pair of connection plates 288a and 288b could be fastened with fastener means 290a, b, such as a nut and bolt combination to the piston extension 286 so as to hold the connector rod 34 in place. Therefore, as the piston and piston rod extension 286 of the double-acting, positive displacement pump 22 reciprocates the connector rod 34 moves so as to cause the cable 262 to reciprocate. The motion of the cable is transformed into a rotation of the sensor pulley 268 which rotation reverses as the cable moves back and forth. The reversing rotation of the sensor pulley is sensed by the pumping means output encoder 250 through its connection to the sensor pulley shaft 272. The encoder 250 measures pump means output as the double-acting pump discharges spray material for each stroke of the piston.

Figure 14:
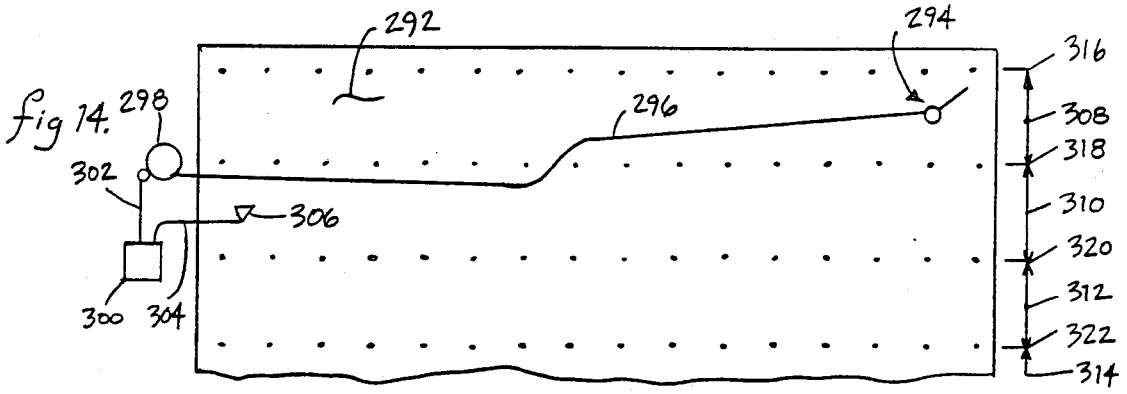
FIG. 14 is a diagram of a surface to be sprayed.
Figure 15:
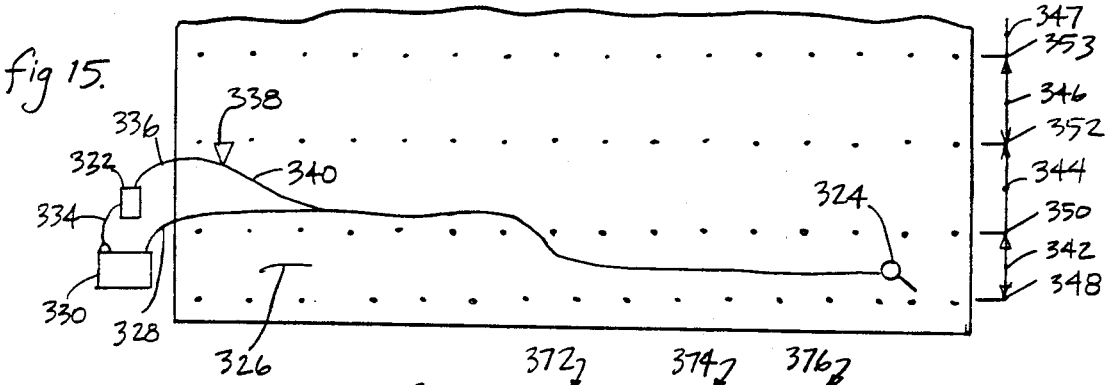
FIG. 15 is a diagram of a surface to be foamed.

Referring next to FIGS. 14 and 15 and first to FIG. 14 there is shown a roof or other surface 292 to be coated, for example, with an elastomeric coating to protect a roof or parking deck. A spray operator having a spray gun and a set of headphones or other signal receiving means is identified with reference character 294. A spray material supply hose 296 extends across the surface 292 and over (or down if on a roof or other elevated structure) to a pump and encoder means combination 298. A controller-counter 300 receives an encoder means output signal by means of an encoder output signal cable or wire 302. The encoder means output signal corresponds to the amount of spray material discharged by the pump means. The counter-controller 300 generates a counter-controller output signal in response to the encoder means output signal. A counter-controller output signal wire 304 extends between the counter-controller 300 and a radio frequency transmitter and an antennae 306, thereby providing means for sending a control signal to the operator 294. Instead of a RF signal a signal cable could be connected, for example, to the operator's headphones. In an economy version of the present invention, a speaker could be mounted within hearing of the operator, thereby providing means for the operator to hear the control signal. A visual signal could also be used, such as a blinking or flashing light or a two color lamp means.

FIGS. 14 and 15 both include grid patterns. In FIG. 14 the grid includes one lane 308, another lane 310, still another lane 312 and part of still another lane 314. The lanes in the grid are defined by one row of lane members 316, another row of lane markers 318, still another row of lane markers 320 and still another row of lane markers 322. The diagram in FIG. 14 is intended to represent a grid for spraying a constant thickness of coating material on to the surface 292. Thus, the marks in each row of lane markers are spaced equidistant from each other. And, of course, the lanes are the same width.

There is shown in FIG. 15 a roof or other surface 326 to be foamed, for example, with an insulating foam to protect and insulate the surface. A spray operator having a spray gun and a set of headphones or other signal receiving means is identified with reference character 324. A foam material supply hose 328 extends across the surface 326 and over (or down if the surface is elevated) to a reciprocating piston foam pump or proportioner and encoder means combination 330. A counter-controller 332 receives an encoder means output signal by means of an encoder means output signal cable or wire 334. The encoder means output signal corresponds to the amount of material discharged by the pump or proportioner means. The counter-controller 334 generates a counter-controller output signal in response to the encoder means output signal A counter-controller output signal wire or cable 336 extends between the counter-controller 332 and either a radio frequency transmitter and an antennae option 338 or an extension 340 of the counter-controller output signal wire or cable 336, thereby providing means for sending a control signal to the operator 324. As discussed above with respect to FIG. 14, an economy version of the apparatus of the present invention could simply have a speaker means mounted within hearing of the spray operator, thereby providing means for the operator to hear the control signal generated by the counter-controller. A visual signal could also be used, such as a blinking or a flashing light, or a two-color lamp means.

In FIG. 15 the grid pattern includes one lane 342, another lane 344, another lane 346, and part of still another lane 347. The lanes in the grid are defined by one row of lane markers 348, another row of lane markers 350, another row of lane markers 352, and still another row of lane markers 353. The diagram in FIG. 15 represents a grid suitable for use when foaming a surface with varying thicknesses of foam. Thus, the marks in each row of lane markers are spaced apart varying distances from each other. However, the lanes are of equal width.

A marking apparatus remote control box 358 can be provided in order to allow the marking apparatus to control a counter-controller 354 connected to the remote control box 358. In a preferred embodiment a signal cable 356 electrically connects the remote control box 358 and the counter-controller 354. A spray gun operator module 360 provides an on-off means for remotely energizing and de-energizing the marker spray gun, for example, the solenoid 124. In a preferred embodiment the marking apparatus remote control box 358 could be connected to marker control output connector 244. A counter reset module 362 provides means for resetting the counter-controller by the marking apparatus operator at the end of spraying one row without stopping to put the cart down at the end of each row. An encoder operator module 364 provides for remote control of the encoder means or rotary encoder 50.

Figure 17:
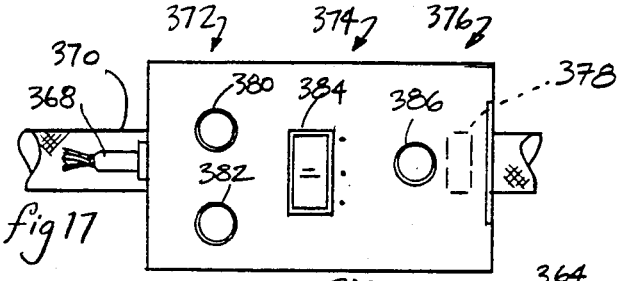
FIG. 17 is a schematic of a spray apparatus of the present invention.
Figure 16:
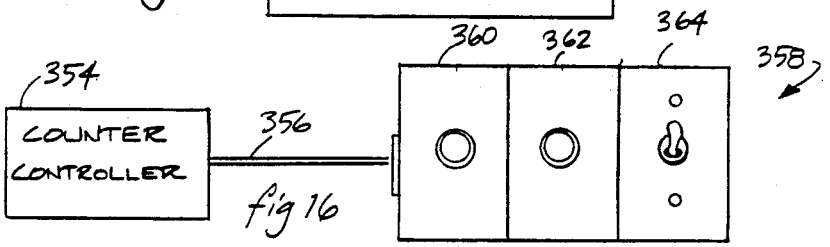
FIG. 16 is a schematic of a marking apparatus control box of the present invention.

A spray remote control box, for example, as in FIG. 17, can be provided in order to allow the spray operator to control the counter-controller which could be located at a remote location and out of the communication range of the spray operator. A spray remote control box 366 is electrically connected with the remote counter-controller by means of a counter-controller signal cable or wire 368. The spray remote control box 366 could be conveniently mounted on a spray hose 370. The spray remote control box 366 could include a limit selector module 372, a limit direction selector module 374, a counter reset module 376 and an annunciator means such as a speaker 378. The limit selector module 372 could include a first limit selector switch 380 and a second limit selector switch 382. The limit direction selector module 374 could include a selector switch 384 for providing a selection of either an increasing limit, a decreasing limit or no limit. The counter reset module could include a counter reset button 386, thereby providing for remote control and selection of these functions by the spray operator. It is believed that this spray remote control box could be used particularly with respect to a foaming operation in which the foam is sprayed on the surface in various or tapering thicknesses.

In operation, in connection with a coating or foaming project, the marking apparatus and cart combination 70 provides means for marking a generally flat surface with a grid. One embodiment will now be described. A grid pattern is selected, for example, a forty (40) inch wide lane is desired. Experience has shown that the forty (40) inch wide lane can be sprayed by an average height operator. Furthermore, using the forty (40) inch wide lane results in thirty (30) lineal feet of lane for one hundred (100) square feet. Using a battery 86 for a power supply results in a portable marking apparatus and cart combination.

The encoder means 82 is chosen presuming that the marker wheel 74 has a three (3) foot circumference such that the encoder means generates a pulse for each one-hundredth (0.01) foot and transmits the pulses through signal line 83 to the counter-controller 90 through encoder connector 240. Logic in the counter-controller 90 counts and totalizes the pulses.

Previously, the limit panels, or at least one of either panel 196 or 198, have been set by either thumbwheel 228 or 234 to a desired limit as shown on either first limit readout 226 or second limit readout 232, or both, and either first limit mode selection switch 230 or second limit mode selection switch 236 has been selected by the operator. It will be understood that if the spray material is to be applied in a constant thickness, then only one limit will be required. If the spray material is a foam to be applied with a varying thickness, then both limits could be used, for example, if two (2) thickness taper rates were required or if the surface to be sprayed included shaded areas where additional foam material would be required to obtain the desired thickness in view of the temperature drop in the cooler, shaded area.

Typically, a comparison means (internal) compares the totalizer value and if it equals the selected limit generates a signal that activates solenoid 124 thereby allowing pressurized marking fluid to exit the spray nozzle 126 and place a lane marker, for example, 158*a* on the surface. The totalizer is reset and the counting, totalizing, comparing and spraying a lane marker, for example, 158*b–g*, continues as the marking apparatus operator continues to roll the cart 74 along the surface to be sprayed. This method of defining the grid sprays either equidistant markers or when foam insulation is to be sprayed the grid must allow for taper of the foam and the distance between the markers can vary.

In the previously described method of defining a grid, the increment mode control switch 206 would be set to the off position. If a grid is required to define a spray pattern for foam (for example, urethane foam insulation) the lane markers in each row will not be spaced equidistant. Thus, the increment mode control switch 206 would be placed in an "increase" made for increasing the spacing to provide a grid, or at least a portion of a grid, for spraying foam of decreasing thickness. The increment mode control switch 206 would be placed in a "decrease" mode for decreasing the spacing to provide a grid, or at least a portion of a grid, for spraying foam of increasing thickness. In this fashion the foam insulation can be tapered in either direction, as desired. In order to obtain the desired tapers of foam on the surface, it may be necessary to mark a grid with different marker spacings. This would be necessary, for example, if the foam insulation on a roof required a plurality of peaks and valleys. The increment panel 190 includes thumbwheel 216 for selecting the desired increasing or decreasing limit, as indicated on readout 214.

It will be understood the components of the counter-controller 90 are known and available from various manufacturers. It will be further understood that assembly of the components can be accomplished by a competent technician. Other components or combinations of components can be used. Counter-controllers specifically for constant thickness coating may not require the incrementing feature or more than one (1) limit selection. The counter-controller means of the present invention includes the features of counting pulses or signals corresponding to a given linear measurement, totalizing the pulses or signals, comparing the totalized value to a limit and finally, generating a control signal for activating a marking means.

An example for a hypothetical assembly of components and spray material coating requirements will now be described to further assist in the understanding of the application of the apparatus and method of the present invention.

The desired spray material coverage is two (2) gallons for each one hundred (100) square feet (or square) of surface to be sprayed. The positive displacement, double-acting, reciprocating piston pump has a piston one inch in diameter It is further known from experience that the spray gun sprays a fan of spray material sixteen (16) inches wide. It is desired that the lane markers be spaced to require four (4) passes of the spray gun for the desired coverage. Since the fan width of the spray is sixteen (16) inches the lane markers should be four (4) inches apart (16/4). Thus, uniform spray coverage will require four passes of the spray gun by the operator to obtain the desired, uniform coverage.

It is desired to place the lane markers every four (4) inches the length of each lane. The lane markers in each row of lane markers then would be placed eight (8) inches apart since there are lane markers on each side of the lane. To better understand this, consider that the spray gun operator typically backs down a lane while moving the spray gun back and forth between consecutive lane markers in accordance with a rhythm established as further described below. With each sweep of the spray gun, for example, from marker 158*a* to 160*a* the operator has moved four (4) inches (in the present example) longitudinally down the one lane 154. A sweep of the spray gun back to marker 158*b* moves the operator four (4) more inches, for a total of eight (8) inches between lane markers 158*a* and 158*b*.

In the present example, the encoder means 82 has been calibrated to generate one hundred (100) signals or pulses for every lineal foot of movement of the marker wheel 74. In order to obtain the desired eight (8) inch spacing the reset panel 192 is set to "66" on the reset limit readout 218 with thumbwheel 220 ($\frac{2}{3}$ foot per mark or $0.66 \times 100 = 66$ pulses). In this example the increment panel 190 should show a reading of "00" or the increment mode control switch could be set to the "off" position.

The spacing between wheels 74 and 76 is forty (40) inches or 3.33 feet. This establishes the distance between rows of lane markers at 3.33 feet. Thus, the lanes (e.g., 154) contain 100 square feet in each 30 lineal feet.

It has been determined (or specified by the spray material manufacturer) that the desired coverage is two (2) gallons of spray or coating material for every square or 100 square feet of surface to be coated. There are 231 cubic inches in a gallon. Thus, it will take 462 cubic inches of spray material on each 100 square feet of surface to be coated. It has been determined that the displacement of the piston movement. Dividing 462 by 0.7854 equals 588 inches of piston stroke to pump the amount of spray material required to cover 100 square feet or each square.

In accordance with the present example there are forty-five (45) lane markers in each row of lane markers for each 100 square feet of surface, or ninety (90) lane markers, counting the lane markers in any of two adjacent rows of lane markers. These ninety (90) lane markers define a 100 square foot grid.

Now the frequency or timing of the control signals to the spray gun operator can be determined.

The spray gun operator shall be signalled ninety (90) times for every one hundred (100) square feet of surface to be coated. It has previously been determined that for every 588 inches of piston stroke that one hundred (100) square feet of surface should be sprayed. The encoder means 250 for the purpose of this example has been calibrated for one hundred (100) pulses or signals for each inch of piston stroke. Thus, there would be 588 inches of piston stroke for each one hundred (100) square feet or ninety (90) markers or 6.53 inches per mark. Therefore, 6.53 inches multiplied by one hundred (100) pulses per inch results in 653 pulses between markers.

The limit of 653 pulses would then be set on either the one limit panel 196 or the other limit panel 198 and activated by the respective mode selection switch 230 or 236.

The spray gun operator should be wearing headphones or other signal receiving means or a speaker provides an audible signal for the operator. The pump is turned on and the counter-controller set and ready to operate. The operator starts at a marker and upon hearing the first signal begins to spray the spray material, for example, along an imaginary centerline between lane marker 172*b* and 174*b*. The signal encoder means 250 generates pulses which are totalized and compared to the set limit. At 653 pulses the counter-controller generates a signal that is transmitted to the spray gun operator. Upon receiving this signal the operator knows that the spray gun now should be directed at marker 174*b* and that the swing back towards markers 172*c* should now begin. This series of steps repeats as the spray gun operator backs along the entire length of the one lane 170. The steps will then be repeated for each lane defined by the grid with any necessary setting changes to the counter-controller for areas of the surface that require a different thickness or a tapered thickness example, for spraying foam insulation).

When spraying foam, such as a urethane foam insulation on a generally flat roof, a taper of between $1\frac{1}{2}$ to $\frac{1}{2}$ inches every 16 feet is typically desired. It can be determined experimentally that a particular foam material could be sprayed $1\frac{1}{2}$ inches thick within 200 pulses or signals from the encoder means and $\frac{1}{2}$ inch thick within 66 pulses or signals from the encoder means.

The desired taper can be obtained by either one of two methods. Either the counter-controller can be set for use in conjunction with the spray gun or the counter-controller can be set for use with the marking apparatus.

If it is desired to define a grid with the counter-controller in conjunction with the spray apparatus, then a preferred method would include marking a grid with parallel lanes and equidistant spaced lane markers, for example, by using the same marker spacing as in the previous example. In this example it was determined that 200 pulses creates a layer of foam $1\frac{1}{2}$ inches thick in a lane forty (40) inches wide for a particular sweep speed by the operator. It was further determined that 66 pulses creates a layer of foam $\frac{1}{2}$ inch thick in a lane forty (40) inches wide for substantially the same operator, spray gun and sweep speed. Thus, 200 pulses equivalent to $1\frac{1}{2}$ inches of foam and 66 pulses equivalent to $\frac{1}{2}$ inch of foam define a standard that can be copied by any spray gun operator when spraying in response to the signals generated for use by the spray gun operator by the counter-controller.

The resulting taper is one (1) inch for each 134 pulses. If the grid pattern is the same as that in the previous example, then there are 48 markers in each 16 feet (note again that the one (1) inch taper is desired over a distance of sixteen (16) feet). It is desired therefore, to reduce the number of pulses between signals to the spray gun operator by 134 pulses in equal increments over 16 feet or 48 markers, or a three (3) pulse increment each time the spray operator is signalled. The increment is set by setting the increasing-decreasing limit to three (3) and setting the increment mode control switch 206 to a decrease. The switch 206 will be changed to the increase setting at the end of sixteen (16) feet. In this way a series of foam insulation "peaks" and "valleys" approximately sixteen (16) feet on center can be sprayed on the roof surface. If the spray control box 366 or an equivalent remote control device is used, then the spray gun operator can switch the counter-controller between an increasing and a decreasing limit mode with the selector switch 384 without returning to the remote pump or signaling a pump crew. It will be understood that the decreasing or increasing limit feature of the counter-controller could be used with the marking apparatus to define or mark a grid with marks placed at increasing or decreasing distances apart in which case the spray apparatus signal to the operator during spraying would be generated at a constant rate since, according to the spacing of the grid pattern more (closer marks) or less (farther apart marks) foam material would be sprayed.

While specific embodiments have been shown and described, many variations are possible. The type or style of spray gun can be selected to suit a particular application or material to be sprayed. Various power supplies can be used although a battery provides for mobility, particularly of the marking apparatus. The pump means is not limited to a positive displacement, double-acting, reciprocating piston-type pump since various pump styles are known that provide a flow or output that can be metered. It would be within the ability of one skilled in the art to use, for example, a rotary-style pump and provide an encoder means to measure the amount of material discharged from the pump and signal a controller with pre-set limits which in turn would signal the operator for proper spraying within a defined grid. The marking apparatus is not limited to the use of a marking wheel since various linear measuring means are known which can be used to generate a signal counter-controller with preset limits which in turn would signal a marking means for proper marking of a grid.

Having described the invention in detail, those skilled in the art will appreciate that modifications may be made of the invention without departing from its spirit. Therefore, it is not intended that the scope of the invention be limited to the specific embodiments illustrated and described. Rather, it is intended that the scope of this invention be determined by the appended claims and their equivalents.

What is claimed is:

1. A method for spraying a generally flat surface with a spray material, the method comprising the steps of:

(a) defining a grid on the flat surface, the grid including a plurality of marks on the flat surface, (b) spacing the plurality marks to correspond to a spray frequency within a corresponding portion of the grid, (c) pumping the spray material from a spray material reservoir to a spray means for directing the spray material on to the generally flat surface, (d) generating a signal corresponding to a desired amount of the spray material pumped to the spray means, (e) transmitting the signal to a spray operator, (f) spraying the generally flat surface within the portion of the grid by the spray operator in response to the transmitted signal, whereby the spray operator puts down a desired amount of spray material on the generally flat surface.

* * * * *